US007503358B2

(12) United States Patent
Chuang

(10) Patent No.: US 7,503,358 B2
(45) Date of Patent: Mar. 17, 2009

(54) QUICK ELEVATING AND MICRO-ADJUSTING DEVICE FOR THE WORKTABLE OF A MANUAL PLANER

(76) Inventor: Bor-Yann Chuang, No. 78, Yungfeng Rd, Taiping City, Taichung (TW) 411

( * ) Notice: Subject to any disclaimer, the term of this patent is extended or adjusted under 35 U.S.C. 154(b) by 313 days.

(21) Appl. No.: 11/518,415

(22) Filed: Sep. 11, 2006

(65) Prior Publication Data

US 2008/0063485 A1 Mar. 13, 2008

(51) Int. Cl.
*B27C 1/00* (2006.01)

(52) U.S. Cl. ..... 144/114.1; 144/129; 144/253.1; 144/253.5; 144/286.5

(58) Field of Classification Search ..... 144/114.1, 144/253.1, 253.5–253.9, 286.1, 286.5, 287, 144/129, 130; 269/303, 315, 318
See application file for complete search history.

(56) References Cited

U.S. PATENT DOCUMENTS 6,513,557 B1 * 2/2003 Chuang ..... 144/129
7,198,082 B2 * 4/2007 Chuang ..... 144/253.8
7,328,732 B2 * 2/2008 Chuang ..... 144/253.8
7,392,830 B2 * 7/2008 Lei et al. ..... 144/253.8
2007/0079901 A1 * 4/2007 Chuang ..... 144/253.8

* cited by examiner

*Primary Examiner*—Shelley Self
(74) *Attorney, Agent, or Firm*—Ming Chow; Sinorica, LLC

(57) ABSTRACT

A quick elevating and micro-adjusting device for the worktable of a manual planer includes a base, a stationary worktable, a movable worktable and an adjustment device. The adjustment device has its support shaft inserted in the fixing holes of two side plates of the movable worktable. The adjustment device has an elevating rod to be moved up or down for actuating the support shaft to quickly move the movable worktable upward or downward. A micro-adjusting rod has its worm engaged with the worm gear of a threaded shaft for rotating together to drive the threaded rod of the threaded shaft to rotate and move the holding frame of the threaded shaft, which is secured on the movable worktable. Thus, by turning the micro-adjusting rod, the movable worktable can be micro-adjusted in position. Thus the worktable can be adjusted quickly and precisely.

6 Claims, 7 Drawing Sheets

QUICK ELEVATING AND MICRO-ADJUSTING DEVICE FOR THE WORKTABLE OF A MANUAL PLANER

BACKGROUND OF THE INVENTION

1. Field of the Invention

This invention relates to an adjustment device for a planer, particularly to one able to quickly and precisely elevate and micro-adjust the worktable of a manual planer.

2. Description of the Prior Art

A conventional planer is provided with an elevating device for adjusting the position of a work piece to be processed. The elevating device of the conventional planer is composed of a base, a movable worktable, a link mechanism and an adjustment unit. The planer is assembled at a fixed location of the base, and the movable worktable is disposed at a preset location of the base. The link mechanism has one end connected with the base and the other end connected with the adjustment unit, which has its front end connected with the link mechanism and pivotally fixed at a preset location of the movable worktable. When the elevating device is quickly moved, the movable worktable will be moved upward or downward on the base.

However, the elevating device for the worktable of the conventional planer has only one single function of adjusting the worktable to a certain height, unable to carry out workpiece processing with precision.

SUMMARY OF THE INVENTION

The objective of the invention is to offer a quick elevating and micro-adjusting device for the worktable of a manual planer, including a base, a stationary worktable, a movable worktable and an adjustment device. The adjustment device is composed of an adjusting block, a micro-adjusting rod, a threaded shaft, an elevating rod, a support shaft and micro-adjustment locking member. The support shaft of the adjustment device has its opposite ends respectively inserted in the fixing holes of two side plates of the movable worktable. The elevating rod can be moved up and down to actuate the support shaft to move and quickly adjust the position of the movable work table. The micro-adjusting rod is formed with a worm engaged with the worm gear of the threaded shaft for rotating together to drive the threaded rod of the threaded shaft to rotate and move the holding frame of the threaded shaft, which is firmly fixed on the movable worktable. By so designing, when the micro-adjusting rod is turned, the movable worktable can be micro-adjusted in position. Evidently, the adjustment device for the worktable of a manual planer in the present invention has both functions of quick adjustment and micro-adjustment for the worktable, able to adjust the movable worktable to a required position quickly and precisely.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
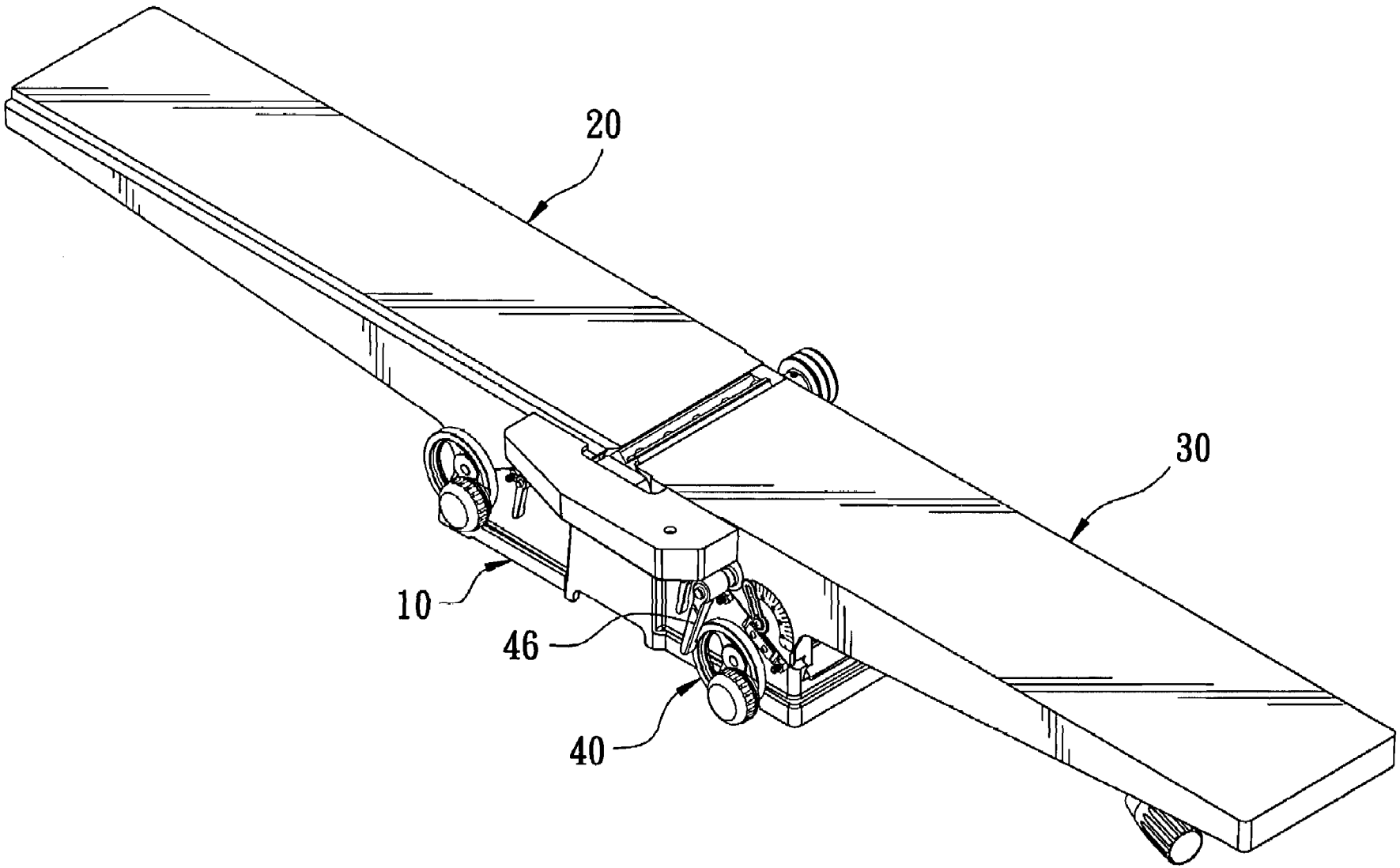
FIG. 1 is a perspective view of a quick elevating and micro-adjusting device for the worktable of a manual planer in the present invention.
Figure 2:
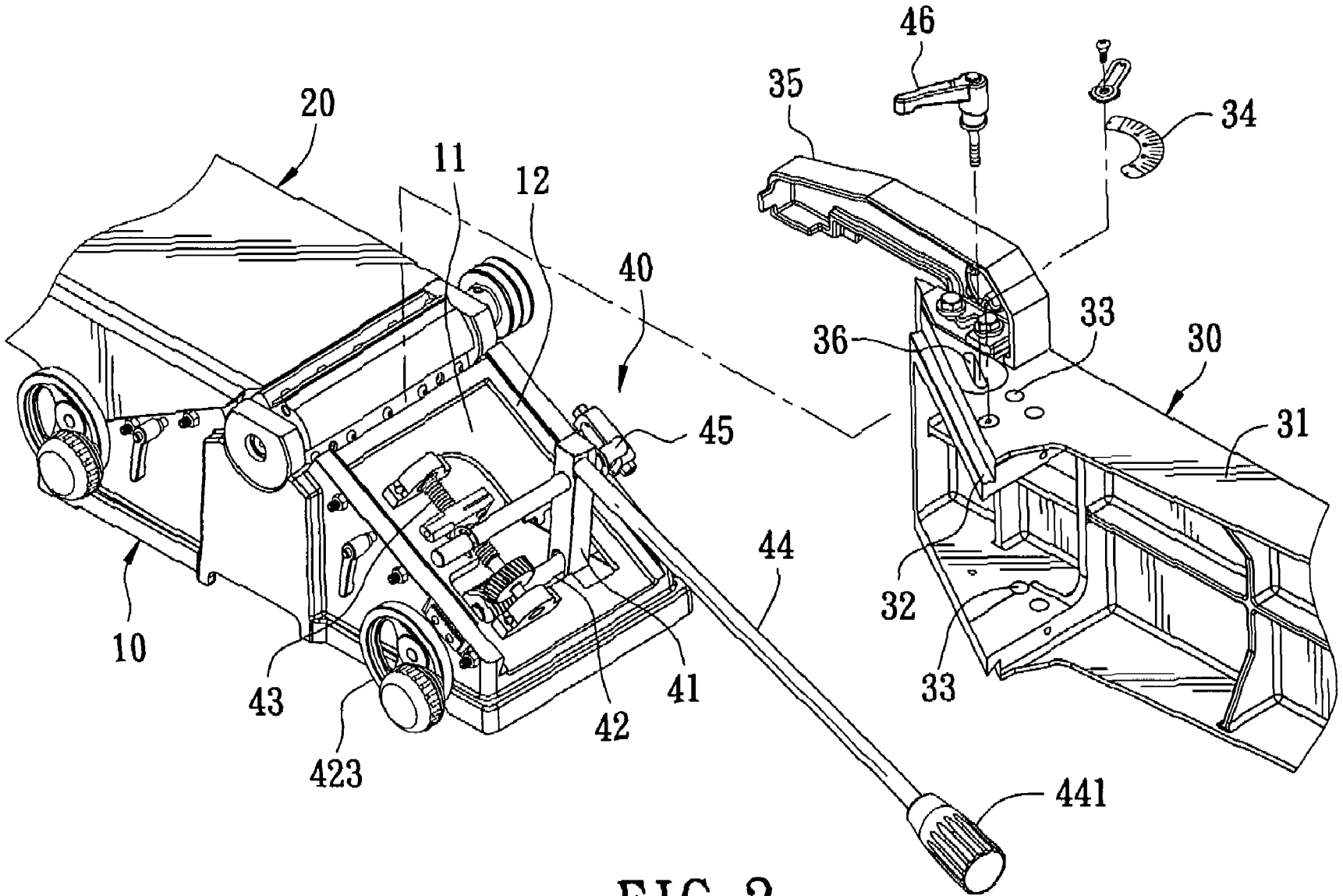
FIG. 2 is a partial exploded perspective view of the quick elevating and micro-adjusting device for the worktable of a manual planer in the present invention.
Figure 3:
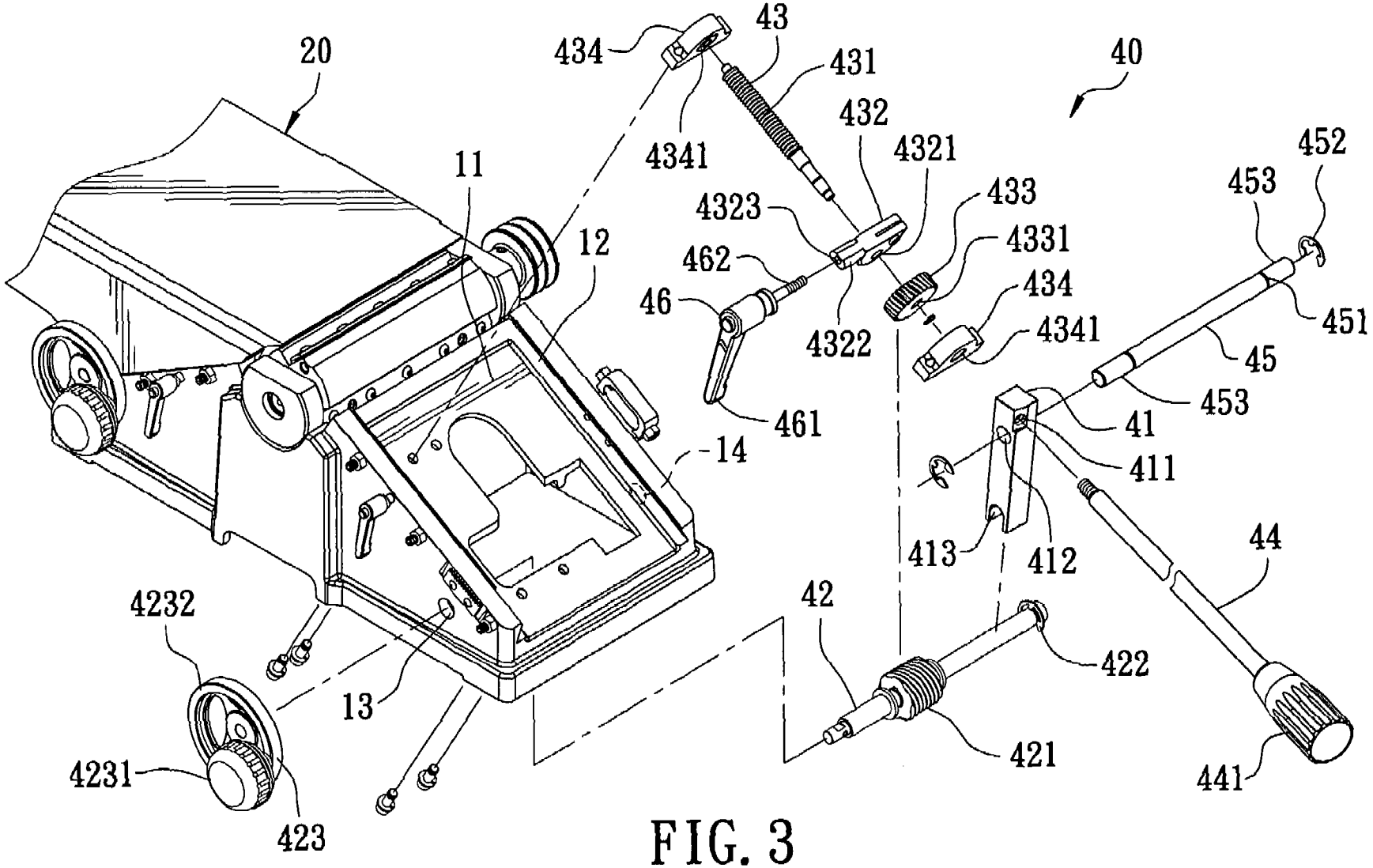
FIG. 3 is a detailed exploded perspective view of the quick elevating and micro-adjusting device for the worktable of a manual planer in the present invention.
Figure 4:
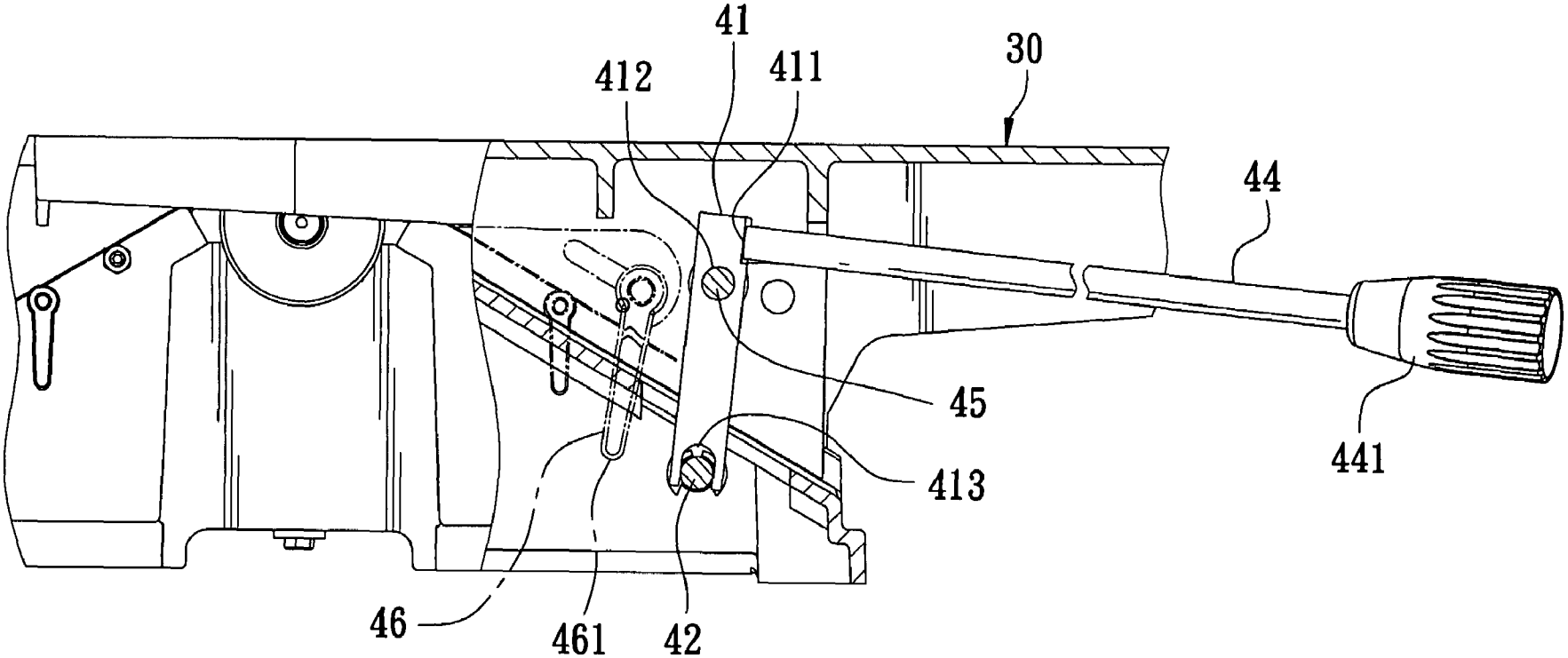
FIG. 4 is a side cross-sectional view of a movable worktable quickly adjusted in position in the present invention.
Figure 5:
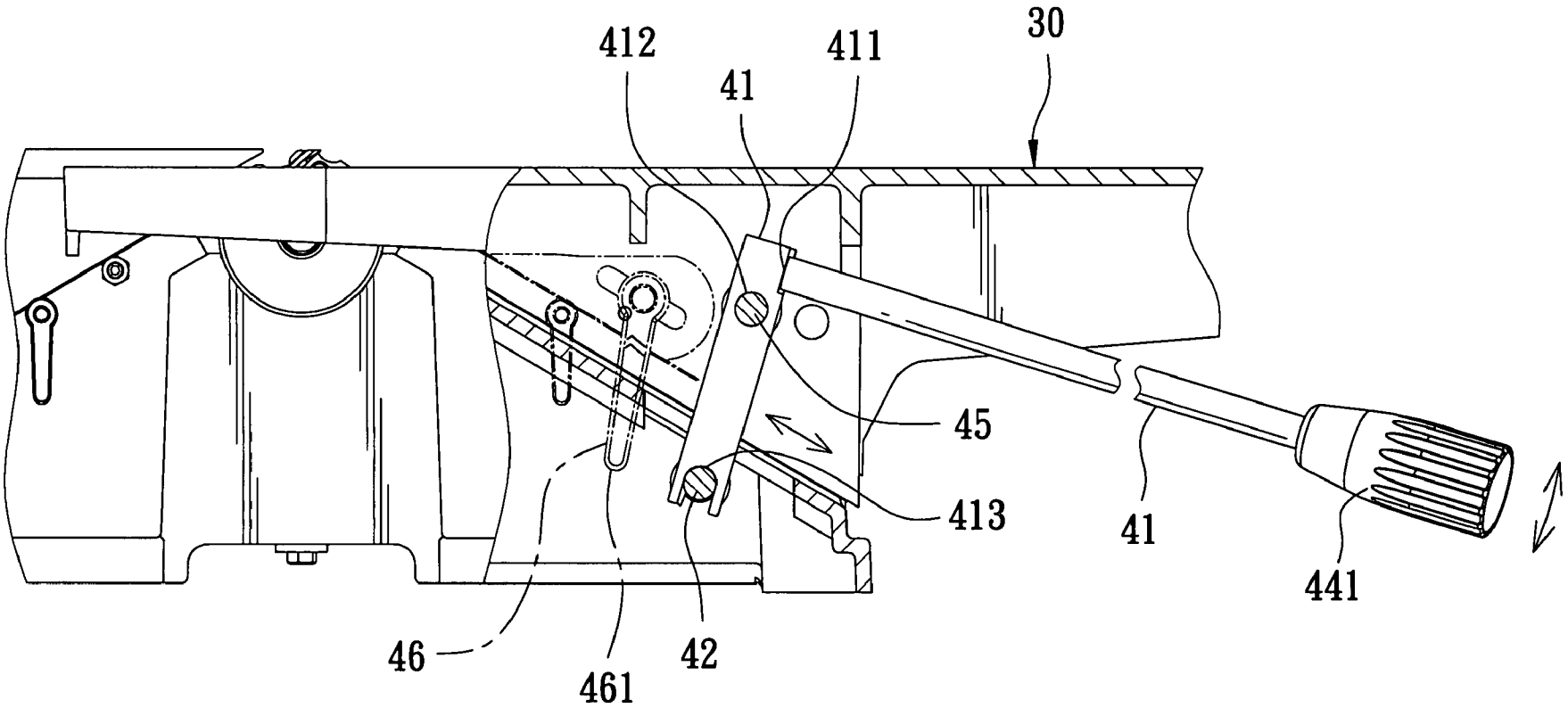
FIG. 5 is a side cross-sectional view of the movable worktable quickly adjusted to shift upward or downward in the present invention.

A preferred embodiment of a quick elevating and micro-adjusting device for the worktable of a manual planer in the present invention, as shown in FIGS. 1, 2 and 3, includes a base 10, a stationary worktable 20, a movable worktable 30 and an adjustment device 40 as main components combined together.

The base 10 has its right side formed with a slant 11 having its front and rear side respectively provided with a dove-tail slide plate 12. The base 10 further has the opposite sides of its right front end bored with an insert hole 13 and a joint hole 14 aligned to each other.

The stationary worktable 20 is firmly positioned at the left side of the base 10.

The movable worktable 30 to be assembled above the right slant 11 of the base 10 has its lower front and rear sides respectively disposed with a side plate 31 having its lower side edge bored with a dove-tail groove 32 matching with the dove-tail slide plate 12 at the front and the rear side of the slant 11 of the base 10 so that the movable worktable 30 can be assembled on the base 10 by mutual engagement of the dove-tail grooves 32 and the dove-tail slide plates 12. Further, the two side plates 31 of the movable worktable 30 are respectively bored with a fixing hole 33, with a graduation ruler 34 secured under the fixing hole 33 of the front side plate 31. Furthermore, a block member 35 is firmly fixed with the front side plate 31 of the movable worktable 30 and a long slot 36 is provided beneath the block member 35.

The adjustment device 40 is composed of an adjusting block 41, a micro-adjusting rod 42, a threaded shaft 43, an elevating rod 44, a support shaft 45 and a micro-adjustment locking member 46.

The adjusting block 41 is bored with a threaded hole 411 at its upper side and a transverse through hole 412 beneath the threaded hole 411. The adjusting block 41 is further has its bottom formed with a pivotal recess 413.

The micro-adjusting rod 42 shaped as a column is formed with a worm 421 at a preset location near its front end. The micro-adjusting rod 42 has its front end inserted through the insert hole 13 of the base 10 and its rear end locked in the joint hole 14 of the base 10 by a C-shaped clasp 422. The pivotal recess 413 of the adjusting block 41 is to be pivotally mounted at a preset location of the micro-adjusting rod 42. In addition, the micro-adjusting rod 42 has its outer end fitted with a micro-adjusting rotary wheel 423 consisting of a rotating disk 4231 and rotating ring 4232. The rotating disk 4231 is secured on the rotating ring 4232 for a user to hold thereon for carrying out micro-adjustment.

The threaded shaft 43 having formed with a threaded rod 431 at the front portion is to be inserted through the threaded hole 4321 of a holding frame 432 and through the fitting hole 4331 of a worm gear 433 that is engaged with the worm 421 of the micro-adjusting rod 42. The threaded shaft 43 has its front and rear end respectively fitted in the combining hole 4341 of two fixing blocks 434, which are fixed on the slant 11 of the base 10. The holding frame 432 is provided with a combining member 4322 extending outward at one side corresponding with a micro-adjustment locking member 46, and the combining member 4322 has its outer end bored with a threaded hole 4323.

The elevating rod 44 has its front end engage with the threaded hole 411 of the adjusting block 41 and its rear end disposed with a grip 441.

The support shaft 45 has an annular notch 451 respectively bored at a preset location of its front and rear end for two C-shaped clasps 452 to be clasped therein. The support shaft 45 is inserted through the transverse through hole 412 of the adjusting block 41 and then has its opposite ends 453 respectively inserted and positioned in the fixing hole 33 of the two side plates 31 of the movable worktable 30.

The micro-adjustment locking member 46 has its rear end fixed with a handle 461 and its front end provided with a threaded rod 462 to be inserted through the long slot 36 of the movable worktable 30 and then screwed with the threaded hole 4323 of the holding frame 432, with the combining member 4322 of the holding frame 432 exactly inserted in the long slot 36 of the movable worktable 30.

In using, referring to FIGS. 3-6, to quickly adjust the height of the movable worktable 30, the handle 461 of the micro-adjustment locking member 46 has to be moved downward to let the threaded rod 462 actuate the combining member 4322 of the holding frame 432 to move away from the long slot 36 of the movable worktable 30 and then the grip 441 of the elevating rod 44 is moved upward or downward. As mentioned above, the elevating rod 44 has one end fixed with the threaded hole 411 of the adjusting block 41, and the support shaft 45 is inserted through the transverse through hole 412 of the adjusting block 41 and has its opposite ends 453 respectively inserted and positioned in the fixing holes 33 of the two side plates 31 of the movable worktable 30. Therefore, with the pivotal recess 413 of the adjusting block 41 pivotally mounted on the micro-adjusting rod 42 and serving as a stationary fulcrum, the movable work table 30 can be quickly moved upward on the base 10 when the grip 441 of the elevating rod 44 is pressed downward. After finishing quick adjustment for the movable worktable 30, the handle 461 of the micro-adjustment locking member 46 has to be pulled upward to let the threaded rod 462 actuate the combining member 4322 of the holding frame 432 to be firmly positioned in the long slot 36 of the movable work table 30, disabling the elevating rod 44 to move no more.

Figure 6:
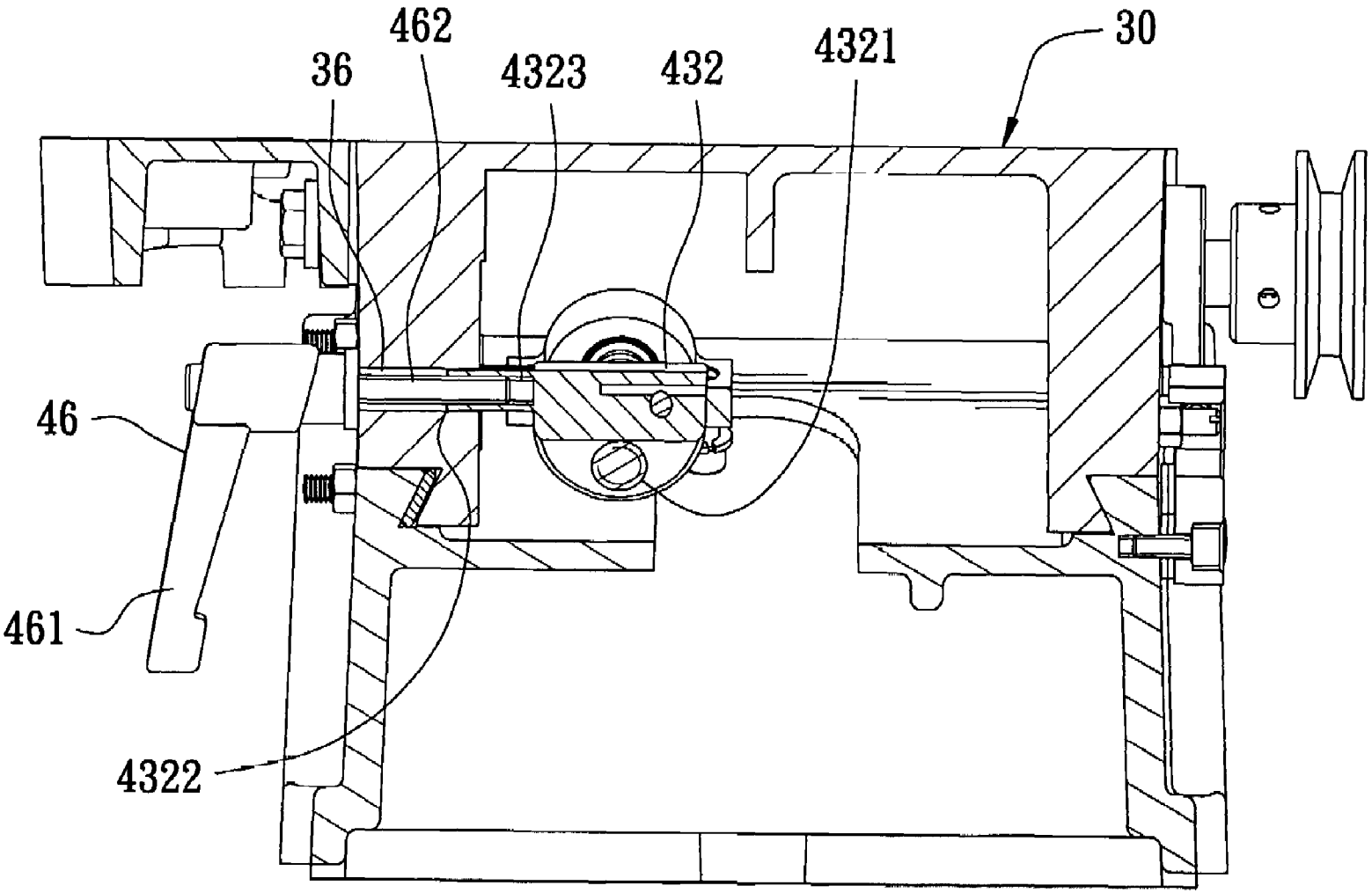
FIG. 6 is a cross-sectional view of a micro-adjusting locking member and its connected structure in a locked condition in the present invention.
Figure 7:
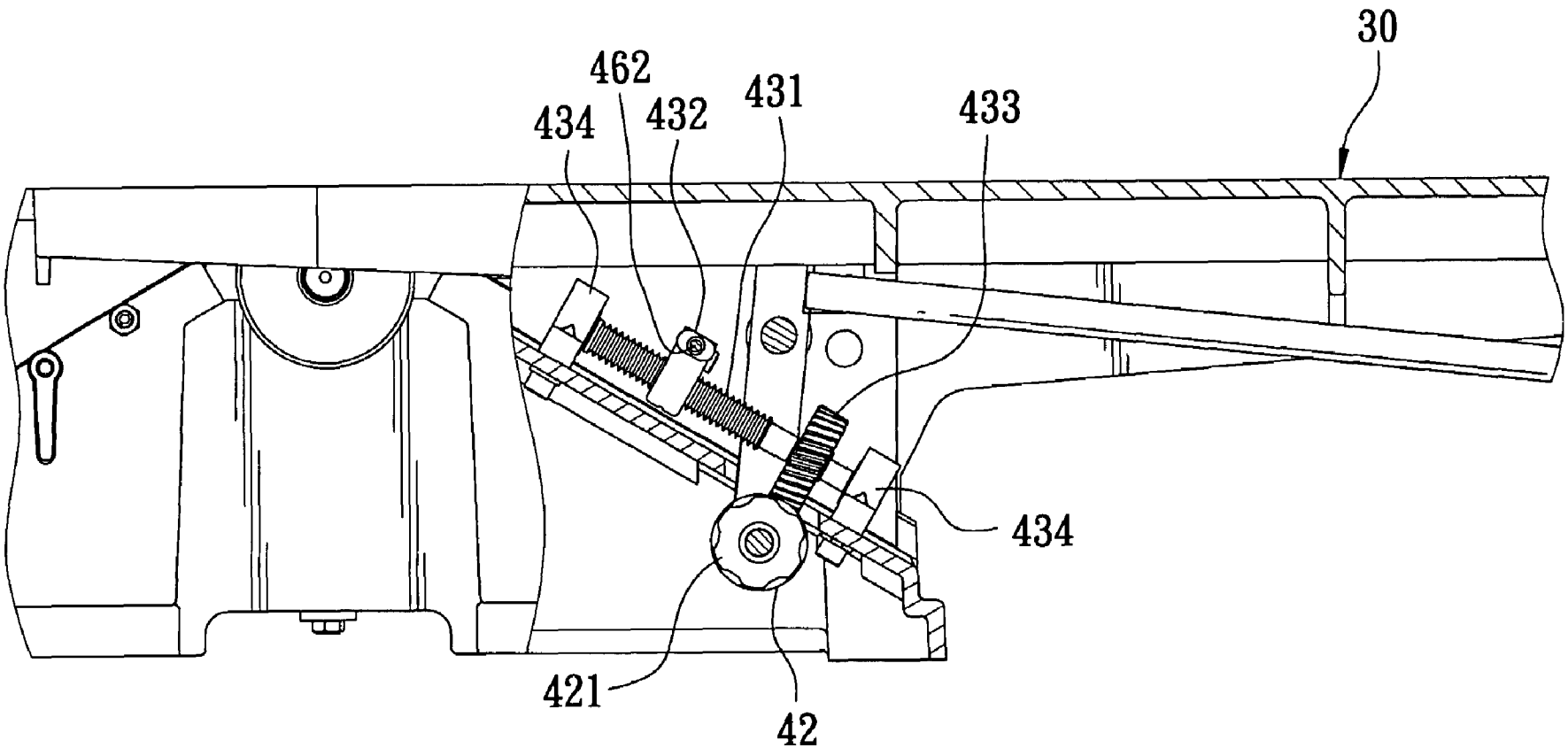
FIG. 7 is a side cross-sectional view of the movable worktable in a micro-adjusted condition in the present invention.

To carry out micro-adjustment for the movable worktable, referring to FIGS. 3, 6 and 7, when the combining member 4322 of the holding frame 432 is firmly positioned in the long slot 36 of the movable work table 30, only turn the micro-adjustment rotary wheel 423 of the micro-adjusting rod 42 to actuate the worm 421 at the front end of micro-adjusting rod 42 to rotate. Since the worm 421 of the micro-adjusting rod 42 is engaged with the worm gear 433 of the threaded shaft 43, therefore, when the worm 421 is rotated, the threaded rod 431 and the holding frame 432 of the threaded shaft 43 will be driven to rotate synchronously and actuate the movable worktable 30 to move upward or downward slightly on the base 10. Thus, by turning around the micro-adjusting rod 42, the movable worktable 30 can be micro-adjusted in position, enabling the movable worktable 30 of the planer to be adjusted quickly and precisely.

In addition, when the movable worktable 30 is moved up and down on the base 10, the graduation ruler 34 fixed at the front lower side of the movable worktable 30 will function to show the elevating value of the movable work table 30 so that a user can timely know the elevated distance of the movable work table 30, convenient in use.

To sum up, the adjustment device for the worktable of a manual planer in the present invention has both functions of quick adjustment and micro-adjustment. After being quickly adjusted to an approximate height required, the worktable of the planer can be micro-adjusted to a precise position, increasing processing speeds and elevating processing quality.

While the preferred embodiment of the invention has been described above, it will be recognized and understood that various modifications may be made therein and the appended claims are intended to cover all such modifications that may fall within the spirit and scope of the invention.

I claim:

1. A quick elevating and micro-adjusting device for a worktable of a manual planer comprises, a base;

a stationary work table;

a movable work table;

an adjustment device;

said base having a right side formed with a slant;

said movable worktable assembled above said slant of said base;

said stationary worktable secured on left side of said base;

said adjustment device composed of an adjusting block, a micro-adjusting rod, a threaded shaft, an elevating rod, a support shaft and a micro-adjustment locking member;

said adjusting block being bored with a threaded hole in an upper side and a transverse through hole underneath the threaded hole;

said adjusting block having a bottom bored with a pivotal recess;

said micro-adjusting rod having an outer end fitted with a micro-adjustment rotary wheel;

said micro-adjusting rod being provided with a worm at a location of a front end;

said micro-adjusting rod having a front end inserted through an insert hole of said base and a rear end fixed in a joint hole of said base;

said pivotal recess of said adjusting block being pivotally mounted on a point of said micro-adjusting rod;

said threaded shaft having its front end formed with a threaded rod;

said threaded shaft being inserted through the threaded hole of a holding frame and a fitting hole of a worm gear;

said threaded shaft having a front and a rear end respectively fitted in a combining hole of two fixing blocks;

said two fixing blocks secured on said slant of said base;

said elevating rod having an inner end secured in said threaded hole of said adjusting block and an outer end disposed with a grip;

said support shaft having its front and rear end respectively cut with an annular groove at a location for two C-shaped clasps to be clasped therein;

said support shaft inserted through said transverse through hole of said adjusting block;

said support shaft having its opposite ends respectively and being pivotally fixed at a location of said movable worktable; and said micro-adjustment locking member having a front end provided with a threaded rod, said threaded rod fixedly connected with said holding frame.

2. The quick elevating and micro-adjusting device for the worktable of a manual planer as claimed in claim 1, wherein said slant of said base has a front and a rear side respectively provided with a dove-tail slide plate.

3. The quick elevating and micro-adjusting device for the worktable of a manual planer as claimed in claim 2, wherein said movable worktable has a lower front and rear side respectively provided with a side plate having a lower side edge bored with a dove-tail groove matching with said dove-tail slide plate of said slant of said base; and said movable worktable able being slidably mounted on said base by mutual engagement of said dove-tail grooves and said dove-tail slide plates.

4. The quick elevating and micro-adjusting device for the worktable of a manual planer as claimed in claim 1, wherein said worm gear of said threaded shaft is engaged with said worm of said micro-adjusting rod.

5. The quick elevating and micro-adjusting device for the worktable of a manual planer as claimed in claim 1, wherein said micro-adjustment locking member has an outer end fitted with a spanner.

6. The quick elevating and micro-adjusting device for the worktable of a manual planner as claimed in claim 1, wherein said micro-adjustment rotary wheel of said micro-adjusting rod is composed of a rotating disk and a rotating ring;

said rotating disk being firmly fixed on said rotating ring.

* * * * *